US008636169B2

(12) United States Patent
Sampaio

(10) Patent No.: US 8,636,169 B2
(45) Date of Patent: Jan. 28, 2014

(54) CADDY AND REMOVABLE MINI CADDY TOTE

(75) Inventor: Andre Sampaio, Valley Cottage, NY (US)

(73) Assignee: Casabella Holdings, LLC, Congers, NY (US)

( * ) Notice: Subject to any disclaimer, the term of this patent is extended or adjusted under 35 U.S.C. 154(b) by 0 days.

(21) Appl. No.: 13/372,295

(22) Filed: Feb. 13, 2012

(65) Prior Publication Data

US 2013/0206754 A1 Aug. 15, 2013

(51) Int. Cl.
*B65D 21/02* (2006.01)

(52) U.S. Cl.
USPC ..... 220/500; 200/23.89; 200/756; 200/555; 200/4.26; 206/581; 206/234; 206/361; 206/518; 206/515; 206/519; 206/203; 206/162; 206/373; 206/503; D3/304; D3/307; D3/315; D3/308

(58) Field of Classification Search
CPC ..... B65D 1/24; B65D 1/36; B65D 21/0212; B65D 21/048; B65D 21/0233; B65D 25/02
USPC ..... 220/23.89, 4.26, 23.6, 555, 756; 206/581, 234, 361, 514, 515–519; D3/304, 308, 307
See application file for complete search history.

(56) References Cited

U.S. PATENT DOCUMENTS 2,212,476 A * 8/1940 Kielberg ..... 220/23.4
2,602,568 A * 7/1952 Kinney, Jr ..... 206/519
2,896,809 A * 7/1959 Metzger et al. ..... 220/553
3,045,863 A * 7/1962 De Chelbor ..... 206/201
3,223,280 A * 12/1965 Kazimier ..... 206/203
3,363,802 A * 1/1968 Cornelius ..... 206/203
3,392,874 A * 7/1968 Peebles ..... 206/514
3,463,353 A * 8/1969 Peebles ..... 206/514
3,907,105 A * 9/1975 Nowak ..... 206/216
3,993,192 A * 11/1976 Bunn ..... 206/515
4,204,596 A * 5/1980 Davis ..... 206/203
4,342,388 A * 8/1982 Torokvei ..... 206/203
4,428,493 A * 1/1984 McDonough ..... 220/555
4,756,420 A * 7/1988 Deaton ..... 206/514
4,759,148 A * 7/1988 Love ..... 43/54.1
4,895,256 A * 1/1990 Johnston ..... 206/501
5,011,013 A * 4/1991 Meisner et al. ..... 206/373
5,086,917 A * 2/1992 Dziersk et al. ..... 206/216
5,154,303 A * 10/1992 Jordan ..... 220/23.86
D330,791 S * 11/1992 Benjamin ..... D3/309
5,199,571 A * 4/1993 Wolff et al. ..... 206/518
D342,813 S * 12/1993 Verchere ..... D32/55

(Continued)

*Primary Examiner* — Mickey Yu
*Assistant Examiner* — Gideon Weinerth
(74) *Attorney, Agent, or Firm* — Curtis, Mallet-Prevost, Colt & Mosle LLP

(57) ABSTRACT

A tote having both a caddy and a removable mini caddy is disclosed. The removable mini caddy attaches to the caddy with a series of guide walls and guide rails that allow the removable mini caddy to be cooperatively received by the caddy. The handle of the removable mini caddy nests with the handle of the caddy while they are attached, providing the user with a single handled tote that is easy to transport and use while still having the convenience of an extra tote where objects can be temporarily removed and then replaced without the need for transferring the objects from one tote to another. The removable mini caddy may be easily removed and then replaced within the caddy while remaining securely in place during use and transport.

13 Claims, 18 Drawing Sheets

(56) References Cited

U.S. PATENT DOCUMENTS

| | | | | | |
|---|---|---|---|---|---|
| 5,318,787 | A | * | 6/1994 | Brauner et al. | 426/120 |
| 5,370,263 | A | * | 12/1994 | Brown | 220/751 |
| 5,392,916 | A | * | 2/1995 | Paulison | 206/518 |
| D357,119 | S | * | 4/1995 | Calmeise et al. | D3/308 |
| D364,039 | S | * | 11/1995 | Kruger | D3/315 |
| 5,503,571 | A | * | 4/1996 | Cheslock | 439/501 |
| 5,547,098 | A | * | 8/1996 | Jordan | 220/23.86 |
| 5,669,498 | A | * | 9/1997 | Fierek et al. | 206/373 |
| D386,616 | S | * | 11/1997 | Nimer | D3/308 |
| D395,362 | S | * | 6/1998 | Fink et al. | D3/307 |
| 5,967,306 | A | * | 10/1999 | Umiker | 206/203 |
| 6,039,205 | A | * | 3/2000 | Flink | 220/659 |
| 6,059,109 | A | * | 5/2000 | Stein | 206/373 |
| 6,062,389 | A | * | 5/2000 | Kent | 206/518 |
| 6,237,796 | B1 | * | 5/2001 | Murphy, Jr. | 220/4.03 |
| 6,460,697 | B1 | * | 10/2002 | Stevens | 206/225 |
| 6,745,895 | B2 | * | 6/2004 | Silvers | 206/233 |
| 7,159,714 | B2 | * | 1/2007 | Wilkinson et al. | 206/366 |
| D541,531 | S | * | 5/2007 | Leao | D3/308 |
| 7,328,814 | B2 | * | 2/2008 | Nordland et al. | 220/756 |
| 7,467,728 | B2 | * | 12/2008 | Lundy et al. | 220/629 |
| 7,497,327 | B2 | * | 3/2009 | Martinez et al. | 206/225 |
| 7,562,787 | B2 | * | 7/2009 | Serrano | 220/507 |
| 8,371,447 | B2 | * | 2/2013 | Dewolf et al. | 206/541 |
| 2005/0211707 | A1 | * | 9/2005 | Mak et al. | 220/23.86 |
| 2006/0226154 | A1 | * | 10/2006 | Lundy et al. | 220/507 |
| 2008/0296194 | A1 | * | 12/2008 | Stahl | 206/518 |
| 2012/0292222 | A1 | * | 11/2012 | Zorzo | 206/515 |

* cited by examiner

CADDY AND REMOVABLE MINI CADDY TOTE

BACKGROUND OF THE INVENTION

1. Field of the Invention

This invention relates generally to totes, and more specifically to a tote having a caddy and a removable mini caddy.

2. Description of Related Art

A tote refers to any structure that can be carried by hand and holds and retains objects. While tote may refer to the act of carrying or transporting something, a tote may also refer to a structure used to carry or transport things. Tote bags are a type of tote, as are tote baskets, tote buckets, tote boxes, tote carts, tote handbags, laundry totes, and the like. Totes in general have been around for thousands of years and have been made from woven reeds, bamboo, wood, bark, sticks, grass, animal hide, animal hair and quills, and other natural materials. Totes have also been made from metals such as copper or iron wire, strips, foil, sheet, and the like. Many modern totes are fabricated from plastic. Most totes have a handle or handles to make the job of carrying a loaded tote that much easier. Totes also are made in various sizes for different applications, and may contain a variety of compartments again depending on the intended application. Other features such as retainers, clips, holes, and the like may also be present on some totes to keep the objects within the tote neat and organized, and to prevent shifting of those objects while transporting the tote.

Oftentimes one will use multiple totes to retain different objects, and to allow one set of objects to be moved independently of the other. This eliminates the problem of transferring some of the needed objects to another location while retaining other objects within the tote, and then replacing those needed objects once they are brought back to the original location. While this may make the job of moving some of the objects easier, it also represents a challenge if a user only has one free hand to work with because the other is already being used to carry something else. What is needed is a way to carry multiple totes with a single hand. What is also needed is a way to temporarily remove some objects from a tote, transport them easily to another location, and then easily return them back to the tote.

It is thus an object of the present invention to provide a tote having a caddy and a removable mini caddy. It is another object of the present invention to provide a tote having a caddy and a removable mini caddy where the handles are nested together in use. It is another object of the present invention to provide a tote having a caddy and a removable mini caddy where the removable mini caddy is secured to the caddy while in use.

These and other objects of the present invention are not to be considered comprehensive or exhaustive, but rather, exemplary of objects that may be ascertained after reading this specification with the accompanying drawings and claims.

BRIEF SUMMARY OF THE INVENTION

In accordance with the present invention, there is provided a tote comprising a caddy and a removable mini caddy. The caddy comprises a handle, at least one compartment, a guide rail, a guide wall generally perpendicular to the guide rail, and a handle stop connected to a lower portion of the handle. The removable mini caddy comprises a handle having a generally concave underside for receiving the handle of the caddy in a nested configuration, a handle guide connected to a lower portion of the handle and continuing with the concave underside of the handle, at least one compartment, a guide wall receiver located along an outer periphery of the removable mini caddy, and a guide wall stop shaped to receive a guide wall of the caddy and located along an outer periphery of the removable mini caddy.

The foregoing paragraph has been provided by way of introduction, and is not intended to limit the scope of the invention as described in this specification, claims and the attached drawings.

BRIEF DESCRIPTION OF THE DRAWINGS

The invention will be described by reference to the following drawings, in which like numerals refer to like elements, and in which.

Figure 1:
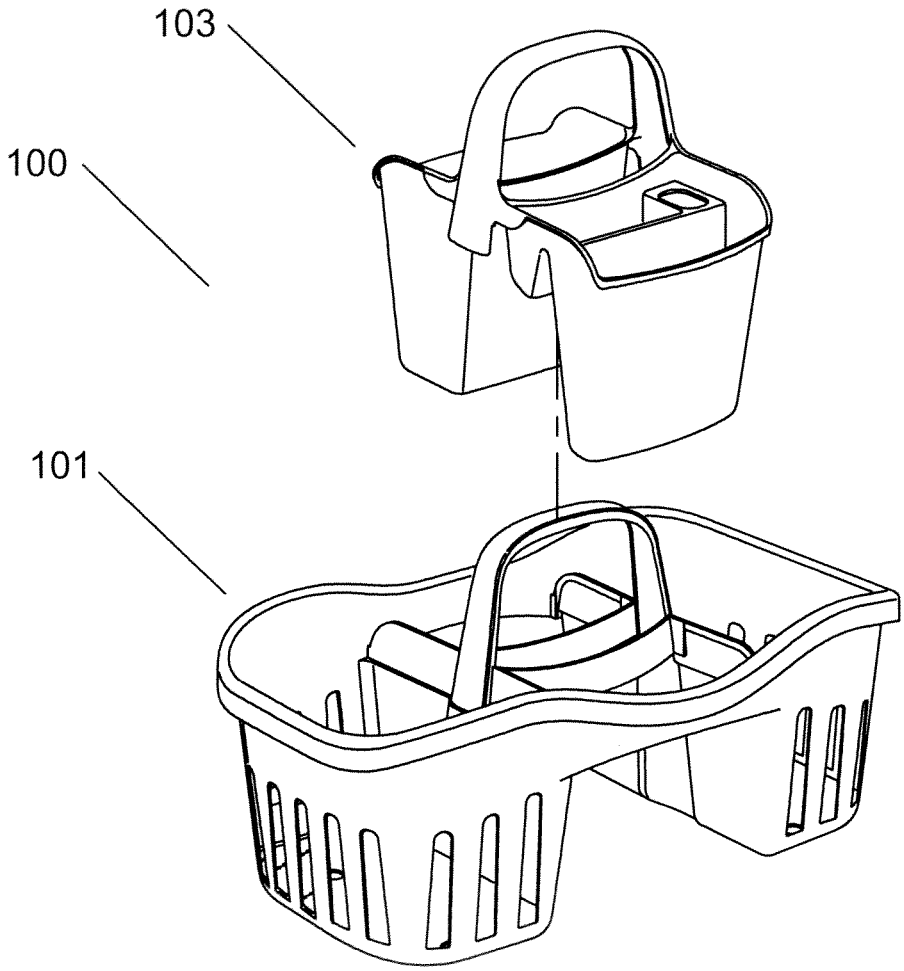
FIG. 1 is a perspective view of the tote with the removable mini caddy being removed from he caddy.

The present invention will be described in connection with a preferred embodiment. however, it will be understood that there is no intent to limit the invention to the embodiment described. On the contrary, the intent is to cover all alternatives, modifications, and equivalents as may be included within the spirit and scope of the invention as defined by this specification, claims and the attached drawings.

Description of the Preferred Embodiments

For a general understanding of the present invention, reference is made to the drawings. In the drawings, like reference numerals have been used throughout to designate identical elements.

The term tote, as used herein, refers to the collective assembly of both a caddy and a removable mini caddy. The attached drawings depict the tote as such an assembly, as well as the caddy alone and also the removable mini caddy alone. The caddy and the removable mini caddy and the way in which the two cooperatively interconnect to form the tote will be further described in this specification. To begin, FIG. 1 is a perspective view of the tote with the removable mini caddy being removed from the caddy. The tote 100 comprises a caddy 101 and a removable mini caddy 103. The removable mini caddy 103 attaches to the caddy with a series of guide walls and guide rails that allow the removable mini caddy to be placed within, and be connected to, the caddy 101. The handle of the removable mini caddy 103 nests with the handle of the caddy while they are attached, providing the user with a single handled tote that is easy to transport and use while still having the convenience of an extra tote where objects can be temporarily removed and then replaced without the need for transferring the objects from one tote to another. The removable mini caddy 103 may be easily removed and then replaced within the caddy 101 while remaining securely in place during use and transport. The novel aspects of the structure of the caddy 101 and the removable mini caddy 103 will be further described by way of the remaining figures and this specification.

Figure 2:
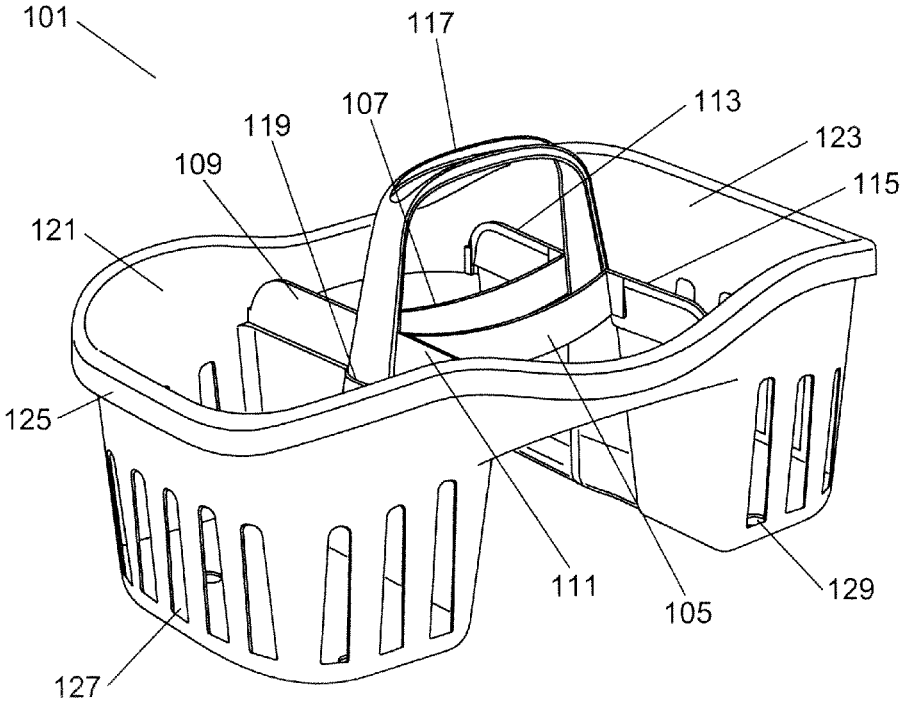
FIG. 2 is a perspective view of the caddy alone.

FIGS. 2-7 depict the caddy 101 without the removable mini caddy 103 for clarity of description. FIG. 2 is a perspective view of the caddy alone. The caddy comprises a handle 117 that may, in some embodiments of the present invention, have features such as a generally concave upper surface for structural rigidity and also for assisting in the retention of the removable mini caddy 103 (not shown, see FIGS. 8-13). Connected to a lower portion of the handle is a first handle stop 119 that provides a ledge or similar raised feature to securely stop and retain the removable mini caddy 103 (see FIGS. 8-13). The caddy 101 further has at least one compartment. A first compartment 121, and in some embodiments of the present invention a second compartment 123 or additional compartments, may also be employed. The caddy 101 further has a rim 125 along the outer periphery of the caddy 101 for structural integrity and also to provide a smooth finish to the periphery of the caddy 101 and related compartments. The caddy 101 and its related compartments may also optionally have slots 127 along vertical walls such as the outer vertical walls of the caddy 101 to improve ventilation and also to reduce plastic cost in manufacturing. The caddy 101 may further optionally have drainage holes that may, in some embodiments of the present invention, have a downwardly directed flange around their perimeter that serves to improve drainage and also acts as feet for the caddy. In addition to the structural features of the handle 117 that provide interoperability with a removable mini caddy (depicted in FIGS. 8-13), the caddy 101 has a guide rail spanning each of the two compartments depicted in FIG. 2, There may be more than one guide rail in some embodiments of the present invention, and the location of the guide rail or guide rails may vary based on the configuration of the caddy 101 and its related compartments. In the example depicted in FIG. 2, a first guide rail 105 and a second guide rail 107 are shown. The guide rails cooperate with and serve to restrict movement of the removable mini caddy 103 (see FIGS. 8-13) by providing a generally planar surface that a vertical wall of the removable mini caddy 103 (see FIGS. 8-13) will abut. Further depicted in FIG. 2 are guide walls generally perpendicular o the guide rails. The guide walls not only provide structure to the caddy 101 in that they may be a continuation of a vertical wall of the caddy or a compartment within the caddy, but they also serve to further restrict movement of the removable mini caddy 103 (see FIGS. 8-13) in an axis perpendicular to the axis of motion that the guide rails act on. The example of FIG. 2 depicts a first guide wall 109, a second guide wall 111, a third guide wall 113, and a fourth guide wall 115. As will be seen in later figures, the guide walls cooperatively couple to guide wall receivers on the removable mini caddy. Various materials may be used to make the caddy and the removable mini caddy. Examples of suitable plastic materials include, for example, low density polyethylene (LDPE), linear low density polyethylene (LLDPE), high density polyethylene (HDPE), polypropylene, and acrylonitrile butadiene styrene (ABS). The caddy and the removable mini caddy may be made by injection molding, blow molding, die cutting, or similar techniques used to fabricate plastic components. Other materials may include various plastics containing reinforcements such as fibers, particles, or the like.

Figure 3:
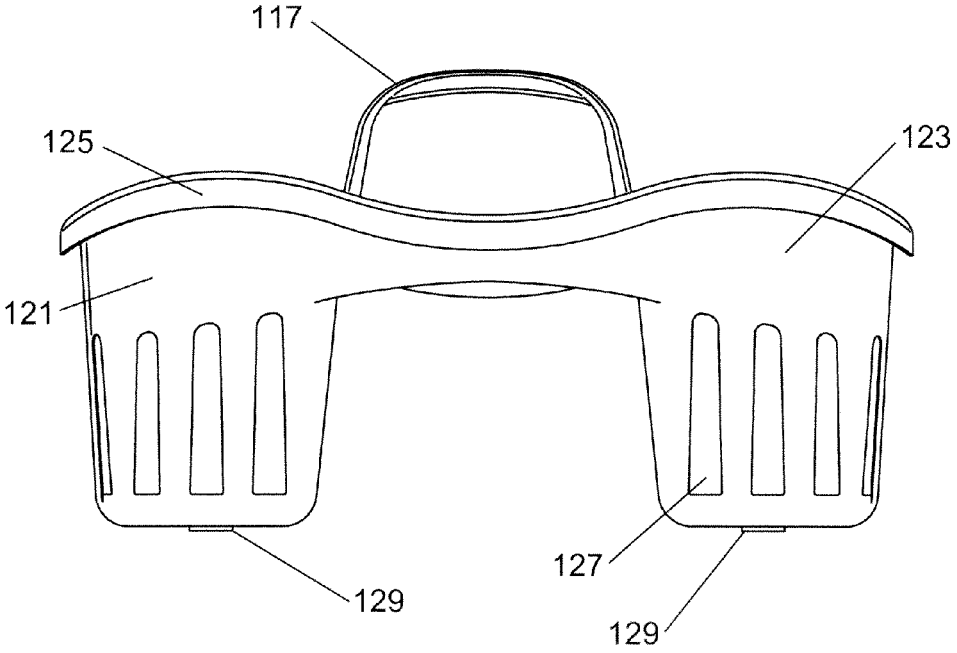
FIG. 3 is a side plan view of the caddy alone.
Figure 4:
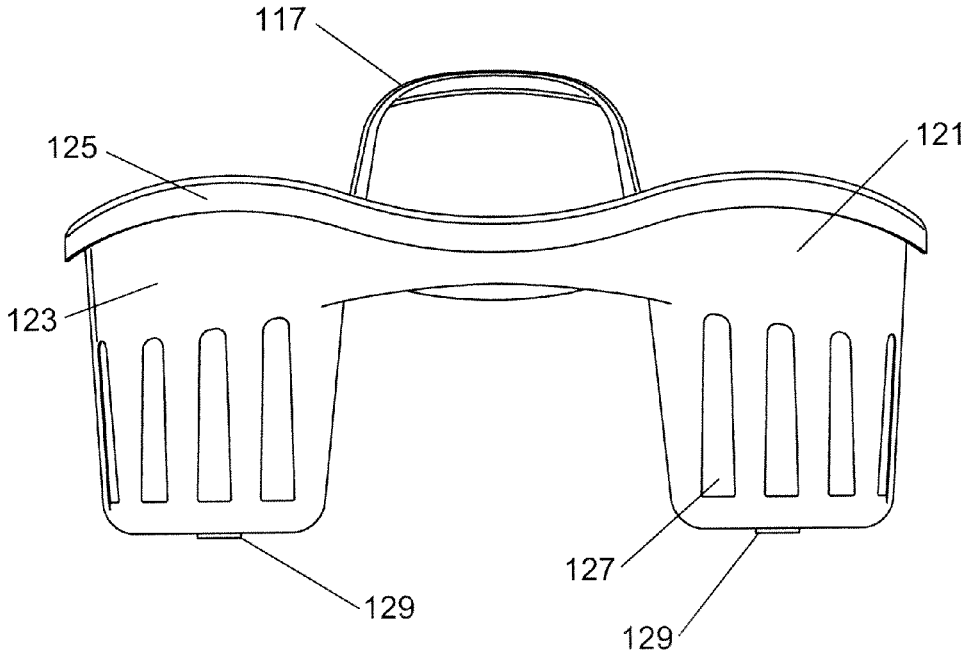
FIG. 4 is an opposite side plan view of the caddy alone.
Figure 5:
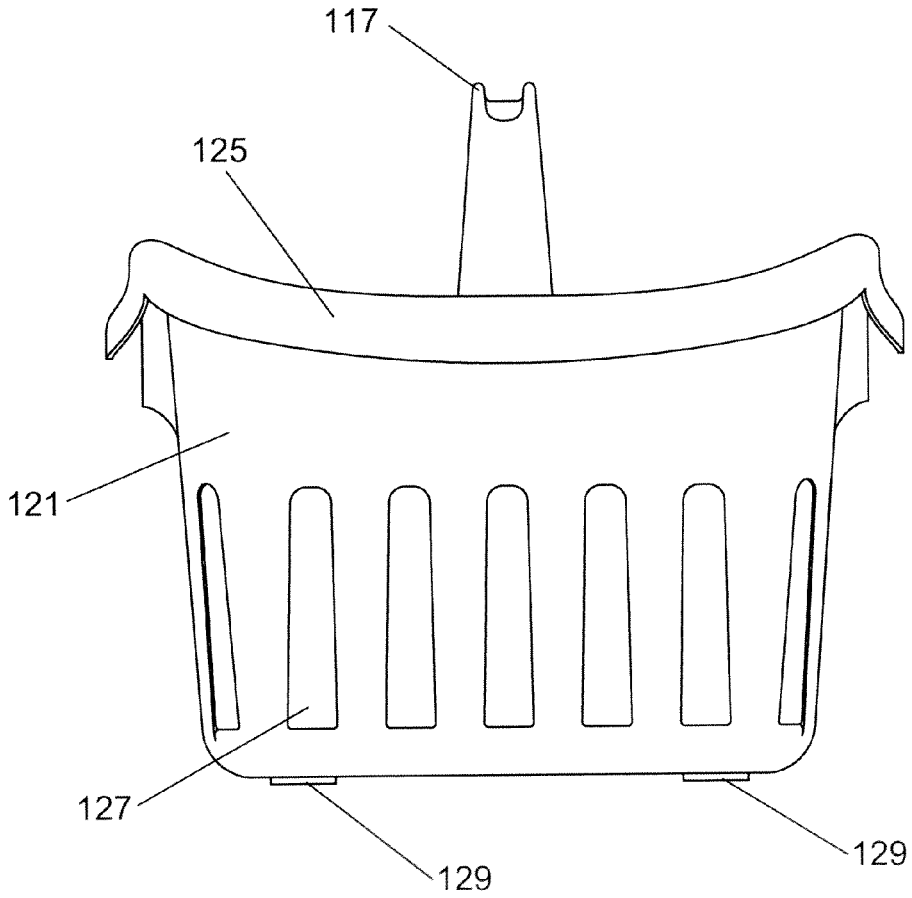
FIG. 5 is an end plan view of the caddy alone.
Figure 6:
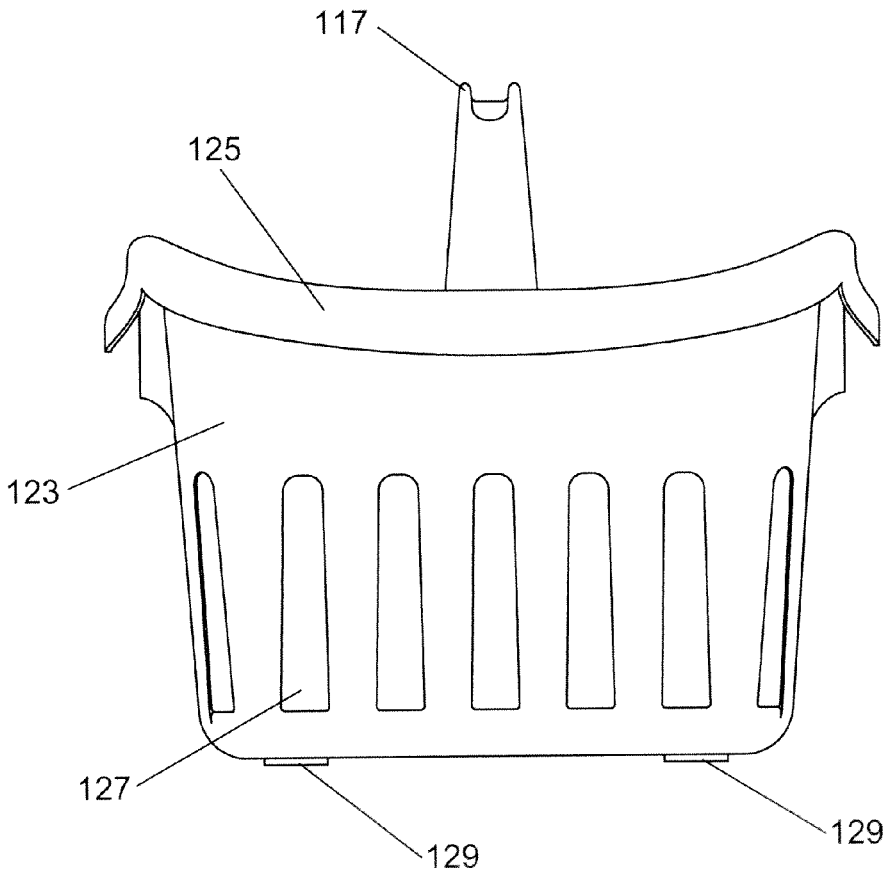
FIG. 6 is an opposite end plan view he caddy alone.

FIG. 3 is a side plan view of the caddy alone and FIG. 4 is an opposite side plan view of the caddy alone. As depicted in FIGS. 3 and 4, the drainage holes 129 may have a downwardly directed flange around their perimeter. Other embodiments of the present invention may omit or modify the downwardly directed flange. Also, as seen in FIGS. 3 and 4, the two sides depicted are of the same general appearance. Now turning to FIGS. 5 and 6, FIG. 5 is an end plan view of the caddy alone and FIG. 6 is an opposite end plan view of the caddy alone. The handle 117 can be seen with a generally concave upper surface for structural integrity and also to better accommodate the handle of the removable mini caddy (see FIGS. 8-13). Various handle geometries may be employed without departing from the spirit and broad scope of the present invention. As can be seen by way of FIGS. 5 and 6, the two ends of the caddy are of the same general appearance.

Figure 7:
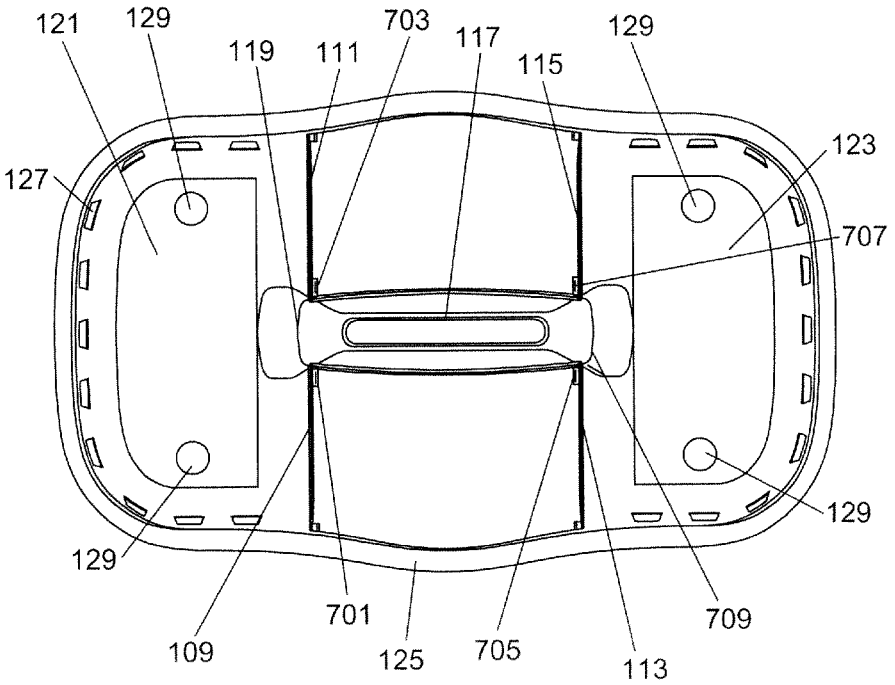
FIG. 7 is a top plan view of the caddy alone.

FIG. 7 is a top plan view of the caddy alone. In this view, a plurality of drainage holes 129 can be seen. Various embodiments may employ different numbers of drainage holes or no drainage holes whatsoever. In the plan view of FIG. 7, supports can be seen. A first support 701, a second support 703, a third support 705 and a fourth support 707 can be seen. Each support is placed between a guide wall and a guide rail, and may be molded from plastic in one piece along with the caddy. The supports provide some strength to the caddy and also create a frictional component that engages with a vertical wall of the removable inner caddy to provide for frictional retention of the removable inner caddy within the caddy.

Figure 8:
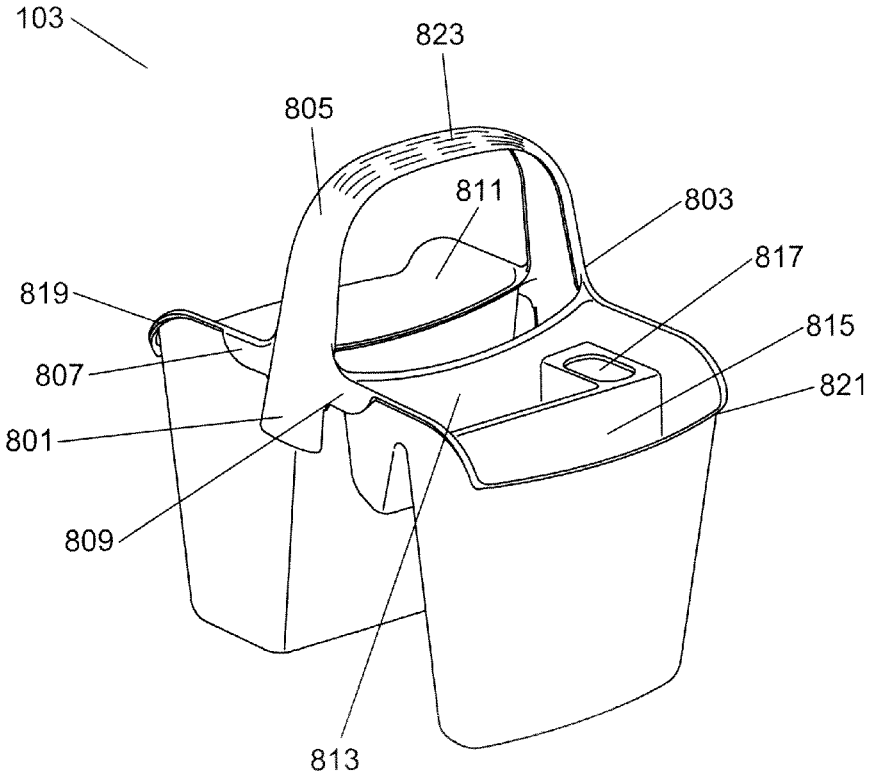
FIG. 8 is a perspective view of the removable mini caddy.
Figure 10:
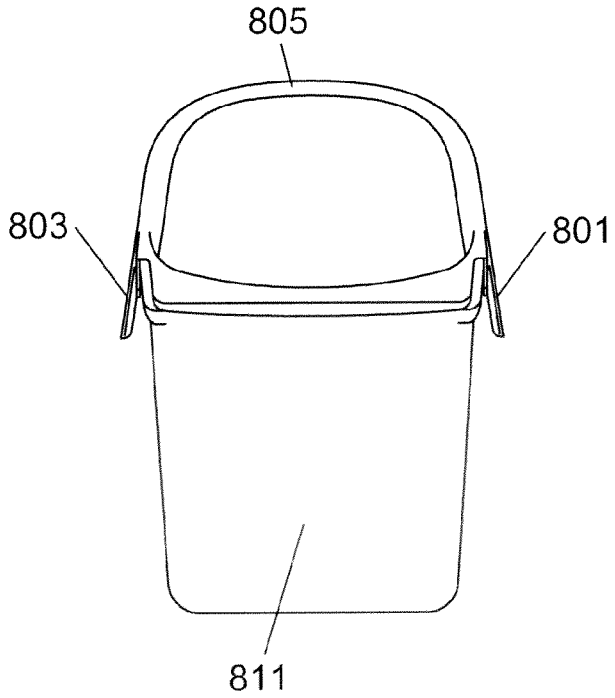
FIG. 10 is an opposite side plan view of the removable mini caddy.
Figure 11:
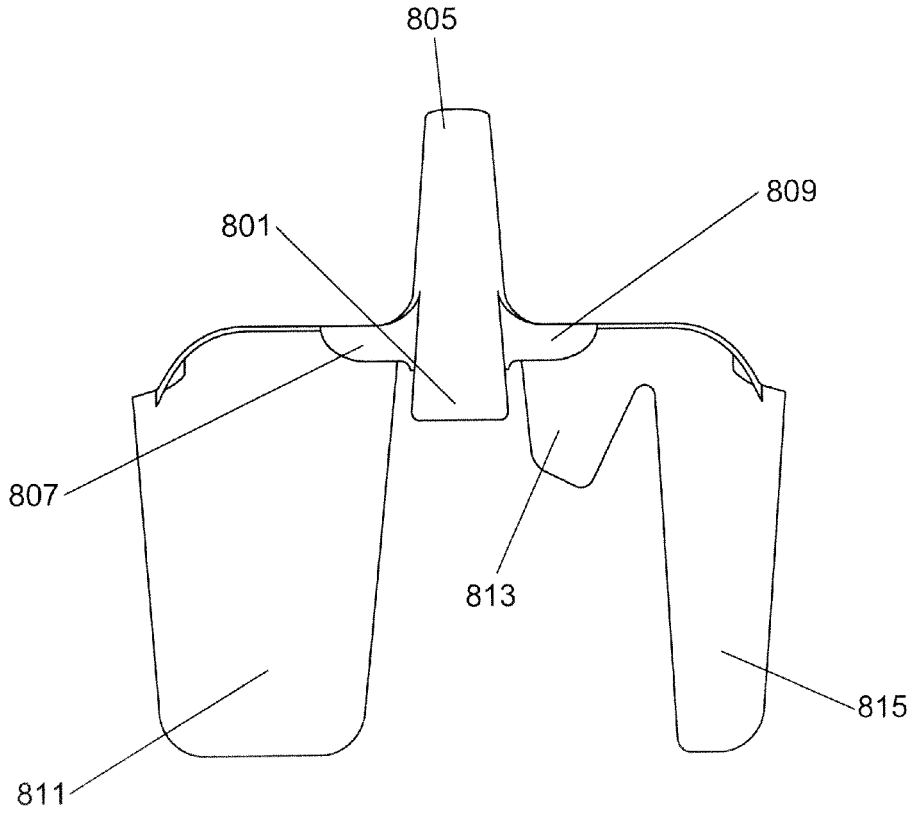
FIG. 11 is an end plan view of the removable mini caddy.
Figure 12:
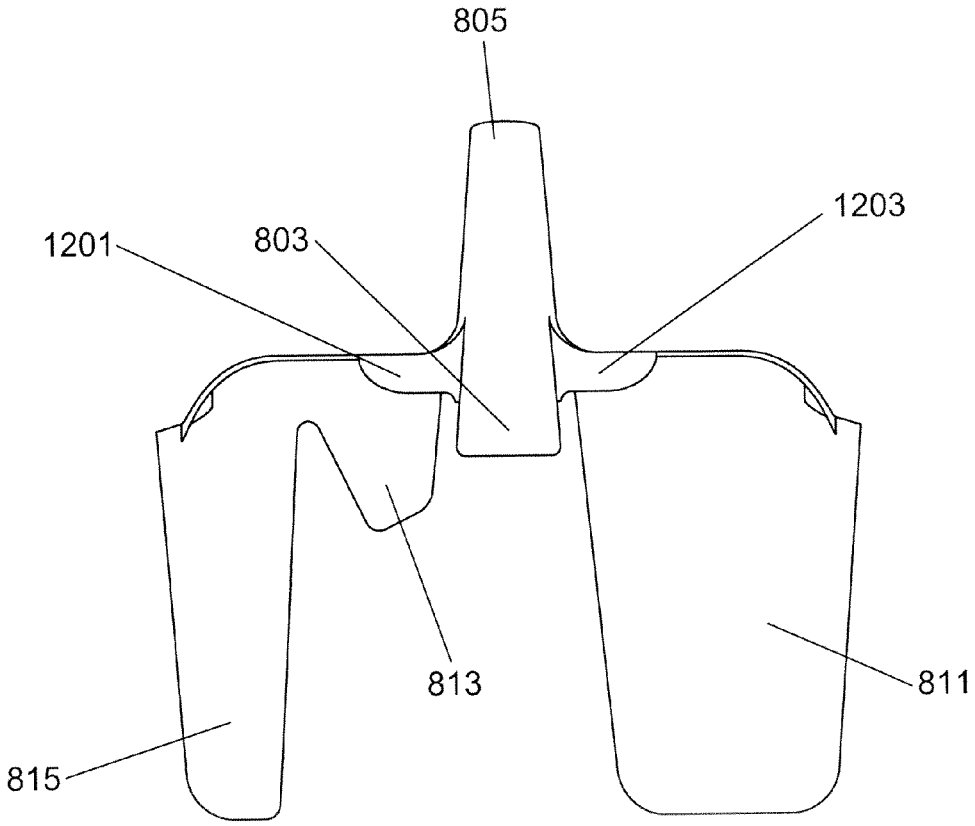
FIG. 12 is an opposite end plan view of the removable mini caddy.

FIGS. 8-13 depict various views of the removable mini caddy 103. FIG. 8 is a perspective view of the removable mini caddy 103. A handle 805 is depicted. The handle 805 has a generally concave underside for receiving the handle of the caddy in a nested configuration. In some embodiments of the present invention, the handle 805 may have ridges 823 within the generally concave underside. A first handle guide 801 and a second handle guide 803 may be seen in FIG. 8. These handle guides are extensions of the handle 805 and can be considered connected to a lower portion of the handle 805. The handle guides each have a concave underside that is an extension and continuation of the concave underside of the handle 805. The first handle guide 801 and the second handle guide 803 serve to receive the handle of the caddy when the removable mini caddy is placed upon the caddy. As previously depicted in FIG. 2 and FIG. 7, the first handle stop 119 and the second handle stop 709 of the caddy serve to halt the downward movement of the removable mini caddy by contacting the ends of the handle stops of the removable mini caddy. A first guide wall receiver 807 and a second guide wall receiver 809 can be seen in FIG. 8. FIG. 12 depicts a third guide wall receiver 1201 and a fourth guide wall receiver 1203. The guide wall receivers are formed of plastic and provide a downward projecting edge or lip that captures and retains a guide wall of the caddy (see FIG. 2, reference numbers 109, 111, 113, and 115). On each of the two end sides of the removable mini caddy, a first guide wall stop 819 and a second guide wall stop 821 can be seen. The first guide wall stop 819 and the second guide wall stop 821 are each located along an outer periphery of the removable mini caddy and are shaped to receive a guide wall of the caddy. The first guide wall stop 819 and the second guide wall stop 821 have a downwardly directed edge or lip that acts to receive a guide wall of the caddy. The removable mini caddy 103 also has various storage areas and features such as, for example, a first storage area 811, a second storage area 813, and a third storage area 815. Various embodiments of the present invention may have differing numbers, sizes and configurations of storage areas. An example of a storage feature is the opening 817. Various materials may be used to make the caddy and the removable mini caddy. Examples of suitable plastic materials include, for example, low density polyethylene (LDPE), linear low density polyethylene (LLDPE), high density polyethylene (HDPE), polypropylene, and acrylonitrile butadiene styrene (ABS). The caddy and the removable mini caddy may be made by injection molding, blow molding, die cutting, or similar techniques used to fabricate plastic components. Other materials may include various plastics containing reinforcements such as fibers, particles, or the like.

Figure 9:
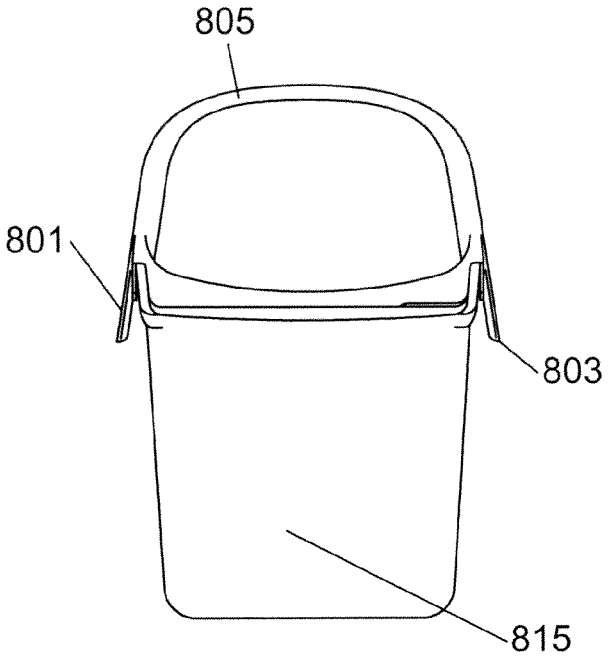
FIG. 9 is a side plan view of the removable mini caddy.
Figure 13:
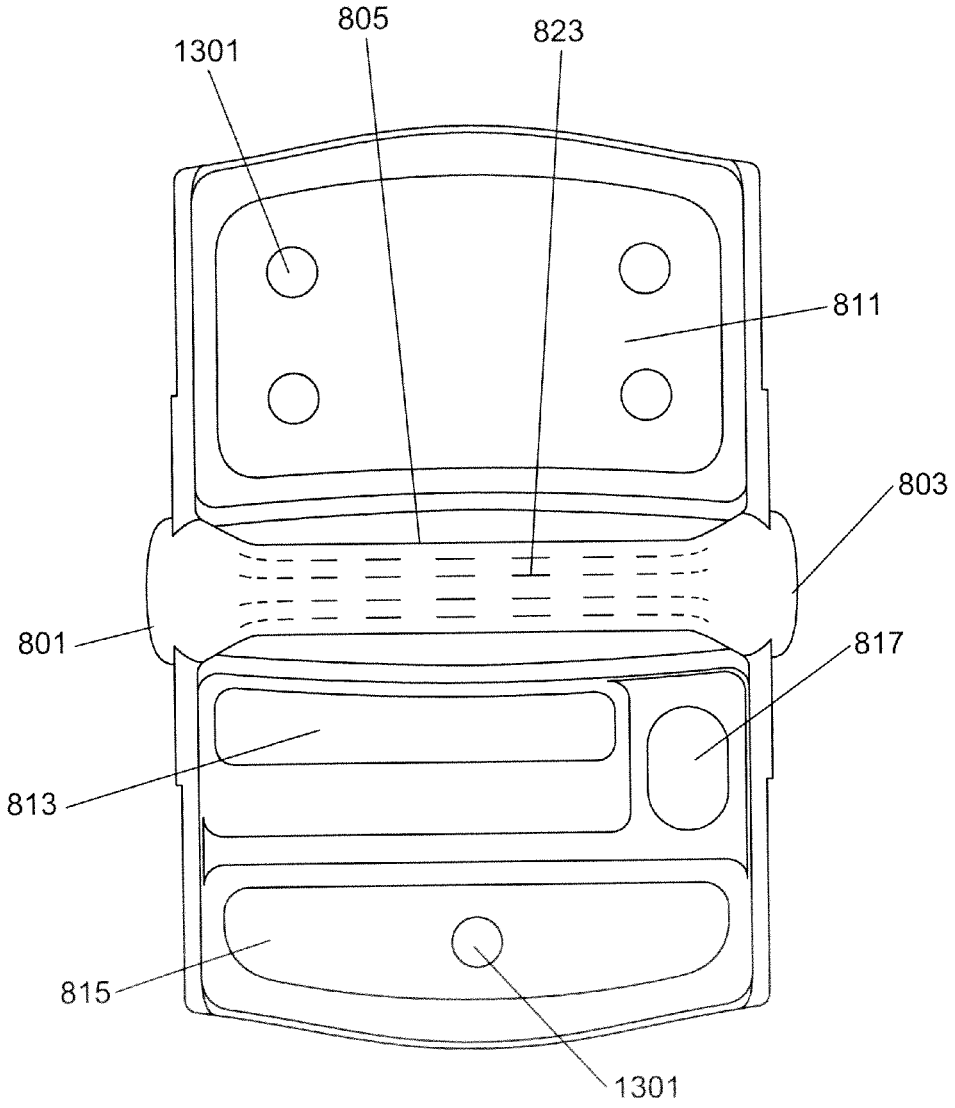
FIG. 13 is a top plan view of the removable mini caddy.

FIG. 9 is a side plan view of the removable mini caddy clearly depicting the first handle guide 801 and the second handle guide 803. FIG. 10 is an opposite side plan view of the removable mini caddy that is generally of the same appearance as FIG. 10. FIG. 11 is an end plan view of the removable mini caddy depicting the first guide wall receiver 807 and the second guide wall receiver 809. The various compartments can also be seen in outline form. Different compartment sizes, configurations and geometries may also be employed in some embodiments of the present invention. FIG. 12 is an opposite end plan view of the removable mini caddy depicting the third guide wall receiver 1201 and the fourth guide wall receiver 1203. To complete the views of the removable mini caddy 103, FIG. 13 is a top plan view of the removable mini caddy. A plurality of drain holes 1301 can be seen. Some embodiments of the present invention may have different quantities or placement of drain holes, or may have no drain holes whatsoever.

Figure 14:
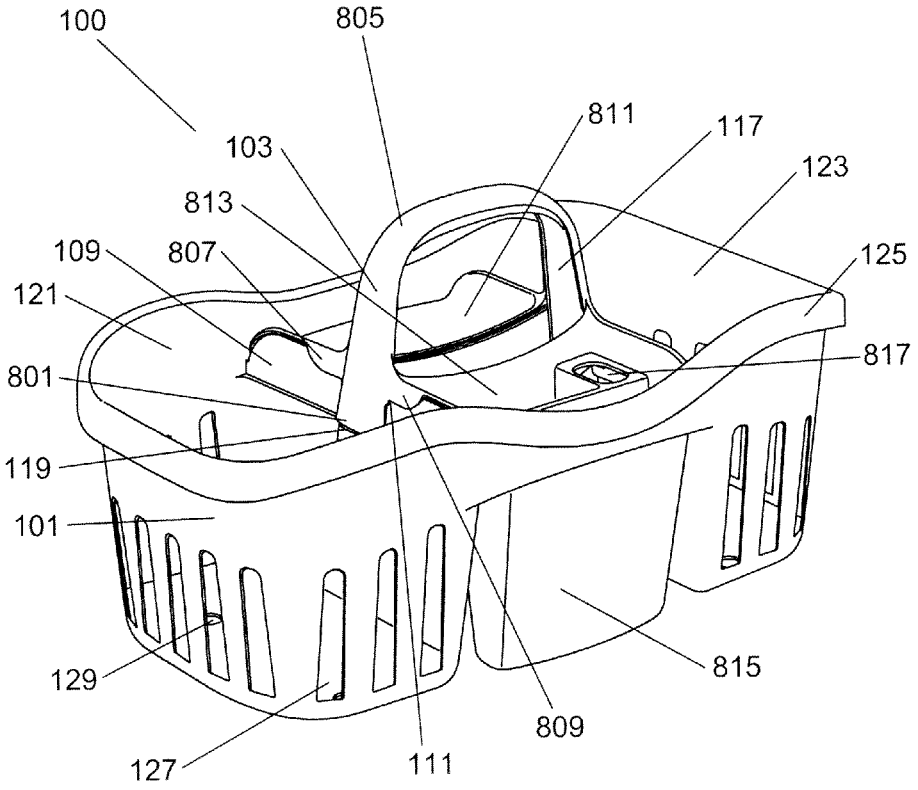
FIG. 14 is a perspective view of the tote with the removable mini caddy in place on the caddy.
Figure 15:
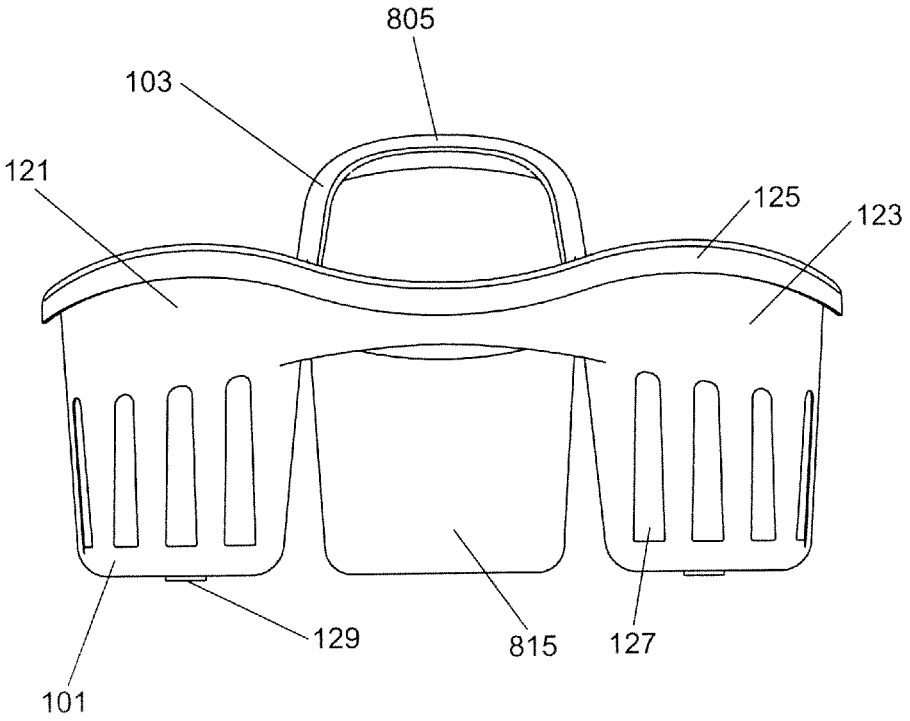
FIG. 15 is a side plan view of the tote with the removable mini caddy in place on the caddy.
Figure 16:
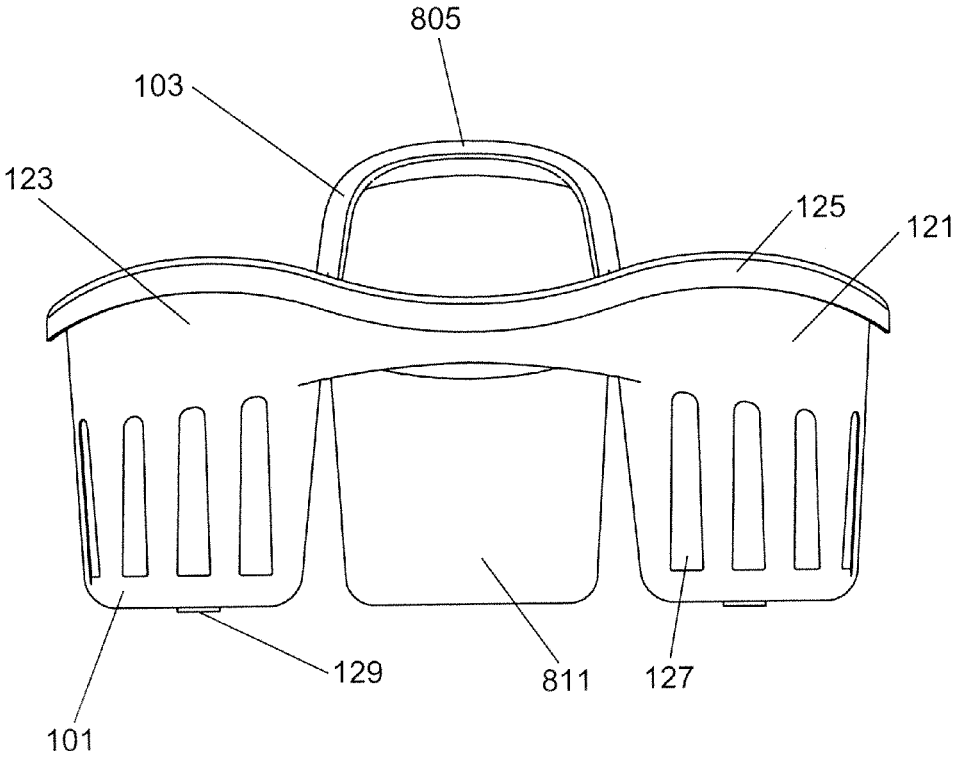
FIG. 16 is an opposite side plan view of the tote with the removable mini caddy in place on the caddy.
Figure 17:
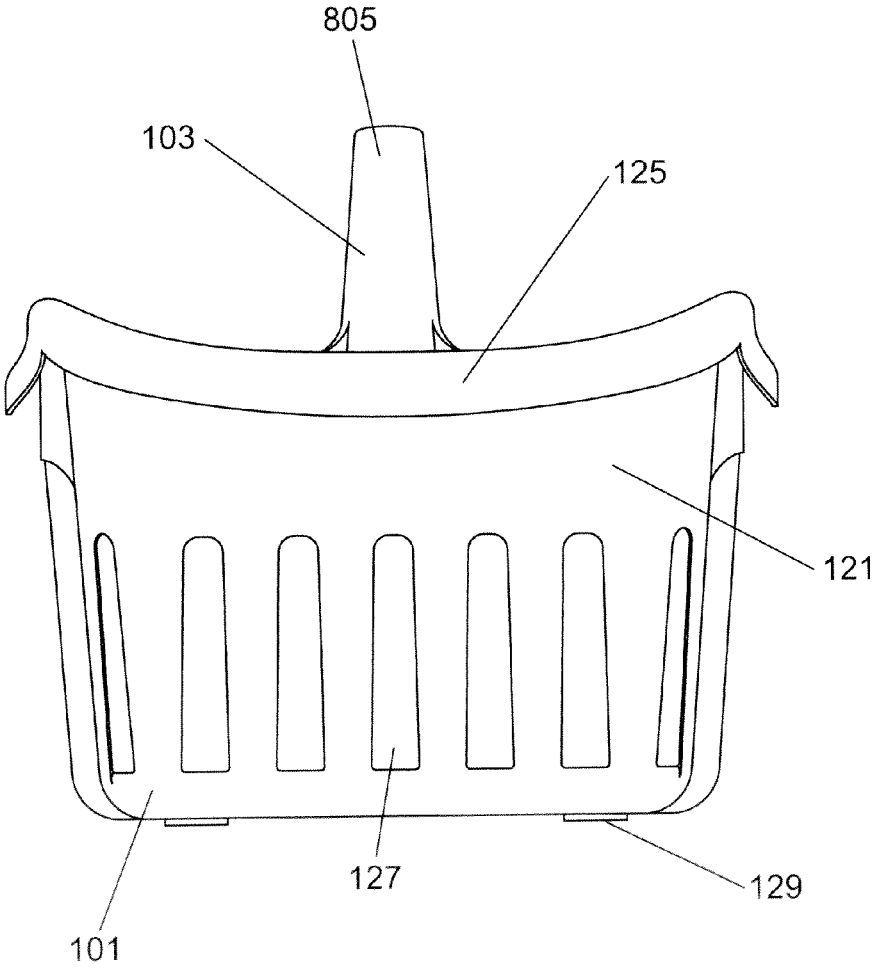
FIG. 17 is an end plan view of the tote with the removable mini caddy in place on the caddy.
Figure 18:
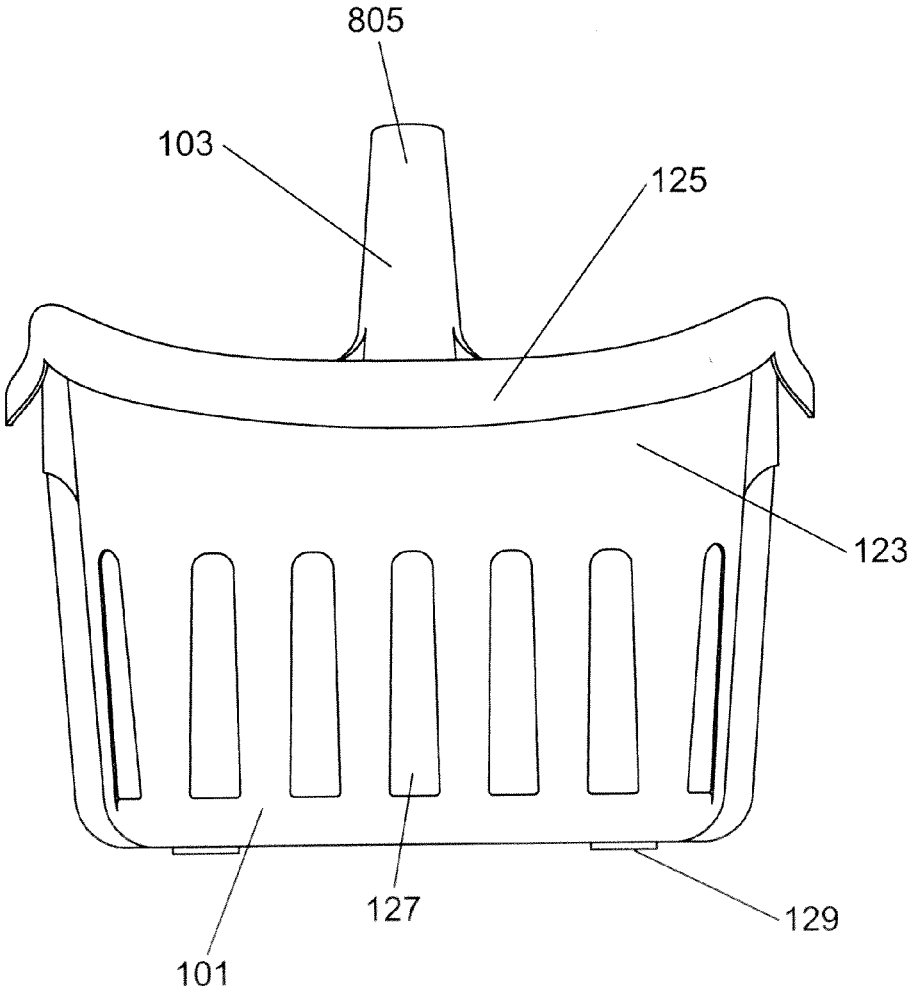
FIG. 18 is an opposite end plan view of the tote with the removable mini caddy in place on the caddy.
Figure 19:
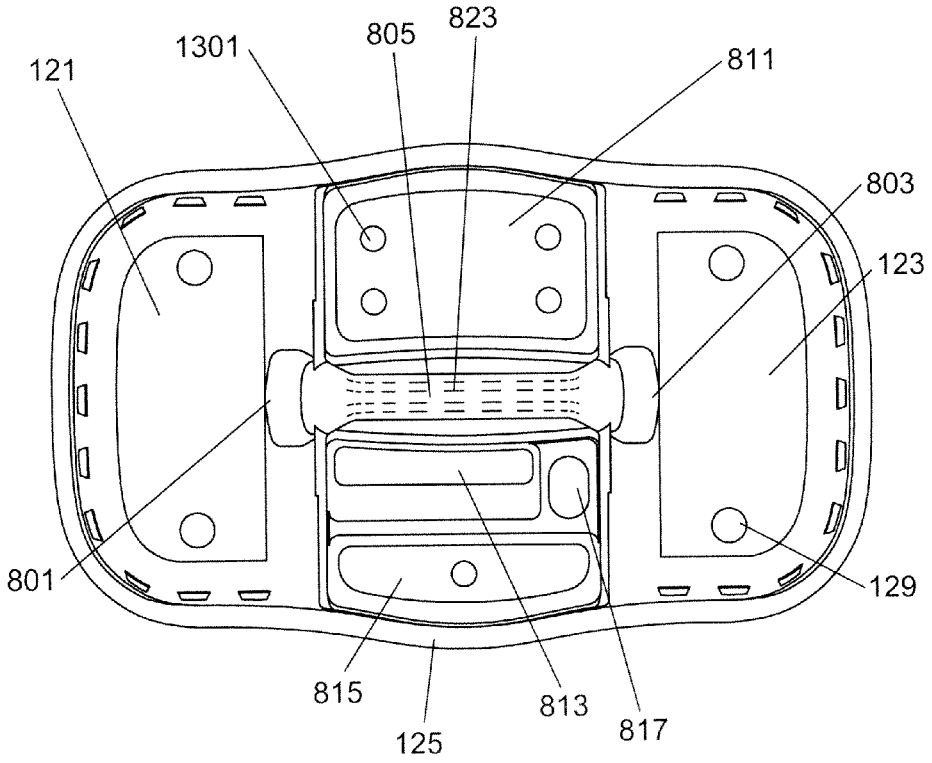
FIG. 19 is a top plan view of he tote with the removable mini caddy in place on the caddy.

The removable mini caddy 103 is placed upon the caddy 101 to form a tote 100. FIGS. 14-19 depict such an arrangement. To use the tote 100, one may either place the removable mini caddy 103 upon the caddy 101, or remove the removable mini caddy 103 from the caddy 101, as clearly depicted in FIG. 1. Materials and objects are placed within the caddy and the removable mini caddy, and removed therefrom. The tote 100 may be transported by way of the nested handles of both the caddy 101 and the removable mini caddy 103, or the caddy 101 and the removable mini caddy 103 may be used separately and transported by their respective handles. FIG. 14 is a perspective view of the tote with the removable mini caddy in place on the caddy. The handle 117 of the caddy can be seen nested within the generally concave underside of the handle 805 of the removable mini caddy 103. In addition, a storage area of the removable mini caddy 103, in this example a third storage area 815, can be seen protruding through the caddy 101. FIG. 15 is a side plan view of the tote with the removable mini caddy in place on the caddy and FIG. 16 is an opposite side plan view of the tote with the removable mini caddy in place on the caddy. FIG. 17 is an end plan view of the tote with the removable mini caddy in place on the caddy and FIG. 18 is an opposite end plan view of the tote with the removable mini caddy in place on the caddy. Lastly, FIG. 19 is a top plan view of the tote with the removable mini caddy in place on the caddy.

It is, therefore, apparent that there has been provided, in accordance with the various objects of the present invention, a caddy and removable mini caddy tote. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims and the attached drawings.

What is claimed is:

1. A tote comprising:

a caddy comprising a handle, a first compartment and a second compartment, a first guide rail spanning from the first compartment to the second compartment, a second guide rail spanning from the first compartment to the second compartment and generally parallel to the first guide rail, a guide wall generally perpendicular to the first and second guide rails, and a handle stop connected to a lower portion of the handle; and a removable mini caddy comprising a handle having a generally concave underside for receiving the handle of the caddy in a nested configuration, a handle guide having a generally concave underside connected to a lower portion of the handle and continuing with the concave underside of the handle, at least one compartment, a guide wall receiver forming a downward projecting recess to accommodate a guide wall and located along an outer periphery of the removable mini caddy, and a guide wall stop projecting tangentially from the outer periphery of the removable mini caddy, the guide wall stop shaped to receive a guide wall of the caddy.

2. The tote of claim 1, wherein the caddy further comprises a second, third and fourth guide wall.

3. The tote of claim 1, further comprising a second handle stop connected to a lower portion of the handle of the caddy.

4. The tote of claim 1, further comprising a rim along the outer periphery of the caddy.

5. The tote of claim 1, further comprising slots placed along an outer vertical wall of the caddy.

6. The tote of claim 1, further comprising drainage holes placed along a bottom surface of the caddy.

7. The tote of claim 6, wherein the drainage holes have a downwardly directed flange around their perimeter.

8. The tote of claim 1, further comprising a support located at an intersecting plane of a guide wall and a guide rail of the caddy.

9. The tote of claim 1, further comprising a second handle guide connected to a lower portion of the handle of the removable mini caddy.

10. The tote of claim 1, wherein the removable mini caddy further comprises a second, third, and fourth guide wall receiver.

11. The tote of claim 1, wherein the removable mini caddy further comprises a second guide wall stop shaped to receive a guide wall of the caddy and located along an outer periphery of the removable mini caddy.

12. The tote of claim 1, wherein the removable mini caddy further comprises ridges along the generally concave underside of the handle of the removable mini caddy.

13. The tote of claim 1, wherein the removable mini caddy further comprises drain holes placed along a bottom surface of the removable mini caddy.

* * * * *